United States Patent [19]

Yamaguchi et al.

[11] 4,367,377

[45] Jan. 4, 1983

[54] HORN LOUDSPEAKER WITH PARTICULAR SUSPENSION AND LEAD WIRE PASSAGE

[75] Inventors: Mitsuhiko Yamaguchi; Masayuki Uchiyama, both of Hamamatsu, Japan

[73] Assignee: Nippon Gakki Seizo K.K., Tokyo, Japan

[21] Appl. No.: 168,414

[22] Filed: Jul. 10, 1980

[30] Foreign Application Priority Data

Jul. 16, 1979 [JP] Japan ..... 54-89264
Jul. 17, 1979 [JP] Japan ..... 54-97588[U]

[51] Int. Cl.[3] ..... H04R 9/04; H04R 9/06
[52] U.S. Cl. ..... 179/115.5 H; 179/115.5 VC
[58] Field of Search ..... 179/115.5 H, 115.5 VC

[56] References Cited

U.S. PATENT DOCUMENTS 1,926,187 9/1933 Young ..... 179/115.5 H
2,037,187 4/1936 Wente ..... 179/115.5 H
4,152,552 5/1979 Meyer ..... 179/115.5 H
4,235,302 11/1980 Tsukamoto ..... 179/115.5 VC

FOREIGN PATENT DOCUMENTS 339312 12/1930 United Kingdom ..... 179/115.5H
490750 8/1938 United Kingdom ..... 179/115.5 H

*Primary Examiner*—George G. Stellar
*Attorney, Agent, or Firm*—Blakely, Sokoloff, Taylor & Zafman

[57] ABSTRACT

In a moving coil type dynamic loudspeaker of the type including a diaphragm vibrated by a moving coil disposed in an air gap of a magnetic circuit comprising permanent magnet, the diaphragm is supported by an annular suspension member. The inner portion of the suspension member is provided with a plurality of equally spaced openings along a circle concentric with the diaphragm and generally radially extending supporting pieces between the openings permit free axial movement of the diaphragm and the moving coil but prevent radial displacement thereof.

3 Claims, 5 Drawing Figures

HORN LOUDSPEAKER WITH PARTICULAR SUSPENSION AND LEAD WIRE PASSAGE

BACKGROUND OF THE INVENTION

This invention relates to a horn type loudspeaker, and more particularly a horn type loudspeaker provided with an equalizer which prevents phase interference occurring at the throat of the horn.

In a loudspeaker of this type, the radiation impedance encountered when transmitting the vibration of a diaphragm to a horn is high because of the provision of the horn, so that this type of loudspeaker can radiate sound at high efficiency. However, such horn has some problems regarding the construction thereof. For example, in a rear type horn loudspeaker disclosed in U.S. Pat. No. 4,050,541 issued on Sept. 27, 1977 to Clifford A. Henricksen, current is passed through a voice coil disposed in an air gap between pole piece elements to vibrate a diaphragm integrated with the coil, the diaphragm being resiliently supported by a frame through a spider, i.e., a suspension member. In this construction, the entire periphery of the diaphragm is connected to the inner edge of the ring shaped spider made of a resilient member.

With the construction disclosed in this U.S. Patent, a portion extending from the diaphragm into the air gap and wound with the coil, the suspension member and the pole piece define an airtight chamber which debases the damping effect of the suspension member which absorbs the vibration created by the axial movement of the diaphragm.

With this construction, the suspension member is required to have the ability of supporting the diaphragm and to damp the vibration. In order to satisfy these two requirements, it is impossible to make too large the axial compliance of the diaphragm. Where the thickness, material and the difference between the inner and outer diameters of the supporting members are selected so as to increase the axial compliance the radial displacement becomes excessive. As a consequence, the coil disposed in the air gap will come into contact with the pole piece and damaged. Furthermore the diaphragm disposed to oppose an equalizer with a small air gap therebetween would contact the equalizer thus damaging the same.

Although these problems can be obviated by increasing the air gap between the pole pieces and the air gap between the diaphragm and the equalizer but widening of these air gaps decreases the sound converting efficiency and the performance of the equalizer.

SUMMARY OF THE INVENTION

Accordingly, it is a principal object of this invention to provided a novel horn type loudspeaker having more excellent characteristics than the prior art loudspeaker.

Another object of this invention is to provide an improved horn type loudspeaker capable of effectively damping the motion of a diaphragm.

Still another object of this invention is to provide a improved horn type loudspeaker capable of increasing the axial compliance component of the diaphragm and minimizing radial displacement thereof.

A further object of this invention is to provide an improved horn type loudspeaker having improved characteristics by decreasing deterioration of the characteristic of the suspension member due to fatigue.

To accomplish these objects, according to this invention, a plurality of openings equally spaced in the circumferential direction are provided for the suspension member.

According to this invention, there is provided a horn type loudspeaker of the type comprising a magnetic circuit including a magnet and yoke member defining an annular air gap therebetween, a diaphragm, a suspension member for supporting the diaphragm, a moving coil connected to the diaphragm and disposed in the annular air gap, the moving coil being passed with sound current to vibrate the diaphragm, a horn disposed in front of the diaphragm, and an equalizer disposed to confront the diaphragm for preventing phase interference of sound waves produced by the diaphragm, characterized in that the suspension member is provided with a plurality of openings along a circle close to a periphery of the diaphragm, the openings being equally spaced along the circle so as to form therebetween a plurality of supporting pieces which permit axial movement of the diaphragm but prevent radial displacement thereof.

DESCRIPTION OF THE PREFERRED EMBODIMENT

Figure 1:
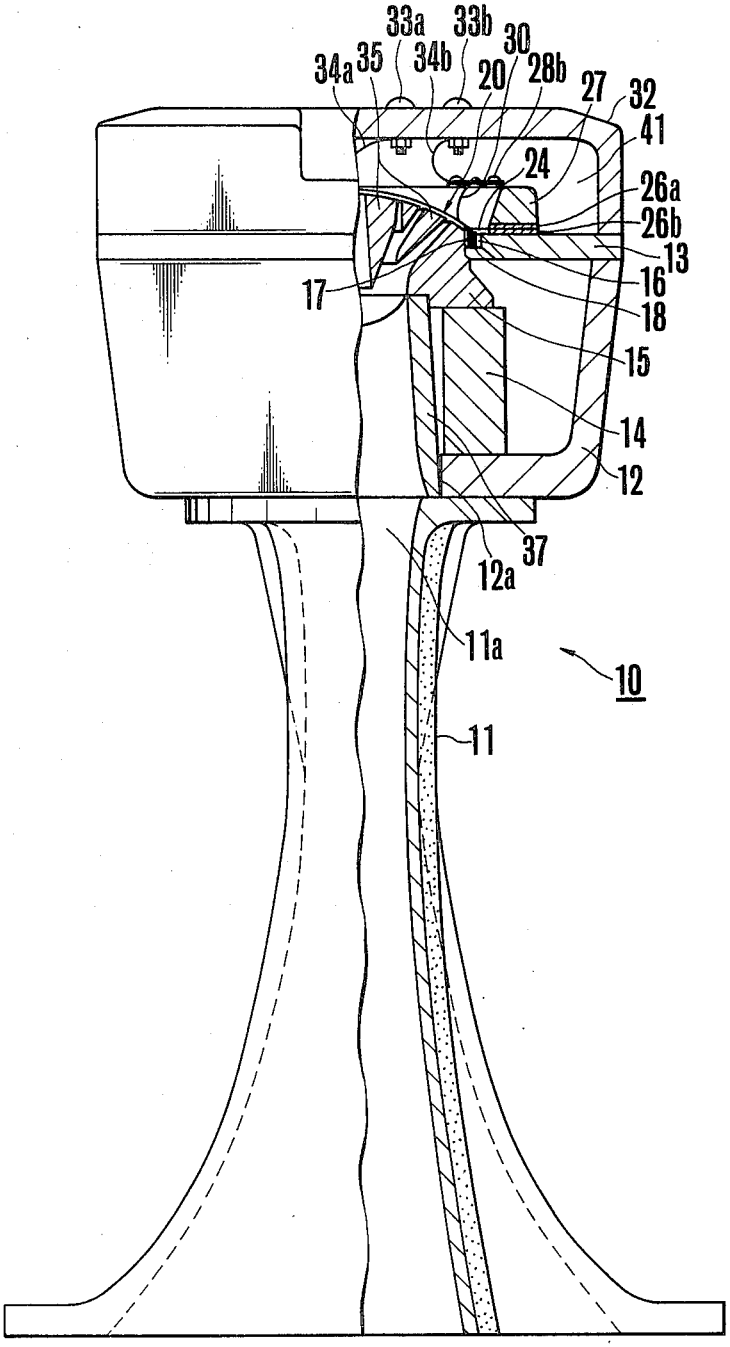
FIG. 1 is a plan view, with right hand half in section, showing one embodiment of the horn type loudspeaker according to this invention.
Figure 2:
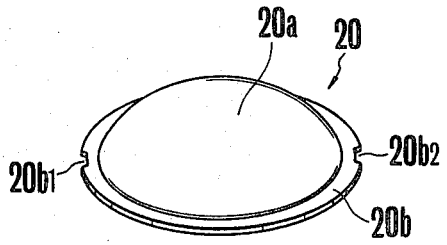
FIG. 2 is a perspective view of the diaphragm utilized in the loudspeaker shown in FIG. 1.
Figure 5:
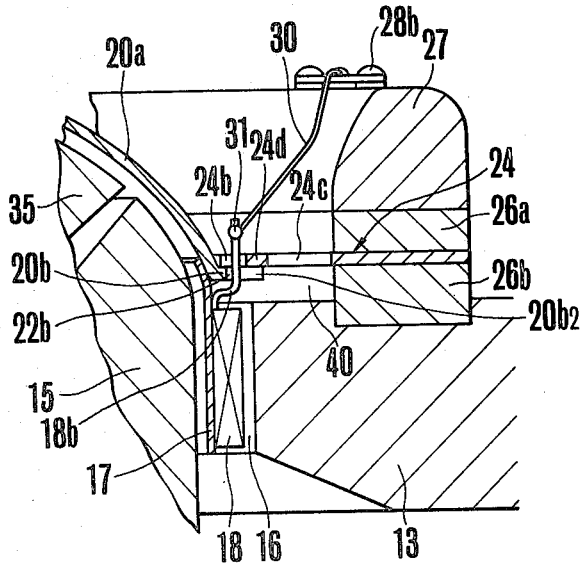
FIG. 5 is a partial enlarged longitudinal sectional view showing the relationship between lead wires of a coil disposed in an air gap between a pole piece and a yoke shown in FIG. 1 and the suspension member of the diaphragm.

The accompanying drawings show a preferred embodiment of the horn type loudspeaker according to this invention, particularly of the rear type. The loudspeaker 10, as generally illustrated in FIG. 1, shown in these drawings comprises a horn 11, a magnetic cup shaped yoke 12 with its bottom connected to the throat 11*a* of the horn 11, an annular shaped yoke plate 13 acting as a pole piece with the periphery connected to the opening of the yoke 12, an annular permanent magnet 14 with one end connected to the bottom of the yoke 12 about the bottom opening 12*a* thereof, the permanent magnet 14 being disposed concentrically with the yoke 12, and an annular pole piece 15 mounted on the upper pole face of the permanent magnet 14. As illustrated in FIG. 5, an air gap 16 of a predetermined width is defined between the outer wall of the pole piece 15 and the inner surface of the yoke plate 13. A moving coil 18 comprising a single layer of turns, for example, wound around a cylindrical bobbin 17 is disposed in the air gap 16. The bobbin 17 is concentrically connected to the skirt of the hemispherical portion or dome 20*a* of a diaphragm 20 made of aluminum, titanium, beryllium, boron or other light metals. As best shown in FIG. 2, the diaphragm 20 has the hemispherical portion 20*a* and a flange 20*b* connected to the skirt of the hemispherical portion 20*a* to extend outwardly.

Two notches 20b1 and 20b2 are provided for the flange 20b and define openings 22a and 22b (22a is not shown) respectively together with corresponding notches of a suspension plate member 24 for passing lead wires of the coil 18. The lead wires 18a and 18b (18a is not shown) of the coil 18 pass through the openings 22a and 22b upwardly, as illustrated in FIG. 5. The suspension member 24 is made of a beryllium-copper alloy plate, for example, and generally takes the form of an annulus. The inner end of the suspension member 24 is overlapped and bonded to the flange 20b of the diaphragm 20 by a suitable binder to form an integrated unit. The inner periphery of the suspension member 24 is formed with notches 24a and 24b at portions corresponding to those of the notches 20b1 and 20b2 of the frange 20b as has already been pointed out.

A plurality of equally spaced openings 24c is formed along a circle near the inner periphery of the suspension member 24. As a consequence, a plurality of supporting members 24f are formed between an inner ring 24d and an outer ring 24e of the suspension member 24. Each of said supporting members 24f comprises a portion positioned between the inner and outer rings 24d, 24e and extending in a circumferential direction, and radially extending connecting members for connecting each end of said circumferentially extending portion to said inner and outer rings 24d, 24e respectively.

The openings 24c and the notches 24a and 24b of the suspension member 24 are formed by photoetching an annular plate member. That is, such formation is performed as described below. On the surface of the annular plate member, a photoresist layer is coated on the surface of the plate member by spreading photosensitive liquid and exposed to a predetermined optical pattern. Then the photoresist layer is developed and is removed in part to expose a portion of the plate member. Further by etching and removing the exposed portion of the plate member, said openings 24c and said notches 24a and 24b are formed. Photosensitive liquid may be applied to the plate member by dipping, roller coating, spray coating and spinner process. For the light to expose the photoresist layer by the light emitted from a carbon arc lamp, xenon lamp, a chemical lamp, a mercury lamp, etc may be utilized. Unwanted portions of the photoresist layer may be removed by dip process, spray process or vapor developing process. Among etching processes may be mentioned dip etching, bubble etching, paddle etching and spray etching. When the suspension member 24 made of a beryllium-copper alloy plate is used, it is preferrable to use the spray, etching. In this case, said annular plate member is coated with a photoresist layer of a predetermined pattern, and sprayed on the surface with the vapor of ammonia (NH3). These etching processes are well known in the art so that detailed description thereof seems unnecessary.

Figure 3:
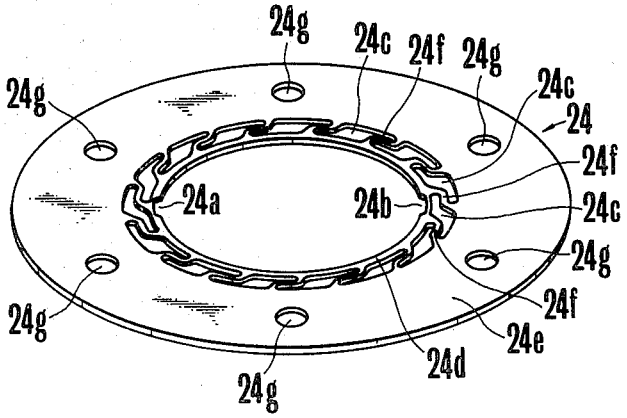
FIG. 3 is a perspective view of the suspension member utilized in the loudspeaker shown in FIG. 1.
Figure 4:
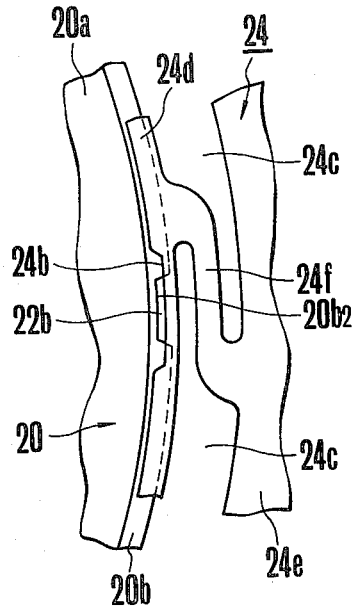
FIG. 4 is a partial view showing the connection between the diaphragm and the suspension member shown in FIG. 1.

Now referring to FIGS. 4 and 5, the outer ring 24e of the suspension member 24 is clamped between packing members 26a and 26b and then secured to the yoke plate 13 by screws via a mounting ring 27. 6 openings 24g shown in FIG. 3 are used to pass the screws. These openings 24g may be formed by photoetching at the same time that the opening 24c and the notches 24a and 24b are formed. On the upper surface of the mounting ring 27 are secured inner terminals 28a and 28b (28a is not shown), and one end of a flexible twisted wire 30 comprising insulating fibers and fine metal wires is connected to the terminal 28b, the other end of the wire 30 being soldered to the lead wire 18b projecting to the rear side of the diaphragm 20 at a point 31. The inner terminals 28a and 28b are connected to external terminals 33a and 33b on a back cover 32 mounted on the yoke plate 13, respectively through conductors 34a and 34b as shown in FIG. 1. It should be understood that in place of said wires 30 for connecting the lead wires 18a and 18b to the terminals 28a and 28b, the prolonged lead wires 18a and 18b to the terminals 28a and 28b may be used.

As generally illustrated in FIG. 1 and as further illustrated in FIG. 5, one surface of an equalizer 35 is confronting the inner surface of the hemispherical portion 20a of the diaphragm 20 with a predetermined spacing therebetween. The purpose of the equalizer 35 is to prevent undue phase interference at high frequencies which occurs when the phases of the sound wave emitted by the central portion of the diaphragm 20 and of the sound wave emitted by the periphery portion of the diaphragm 20 differ greatly at the throats 37 and 11a of the horn 11. For example, the equalizer 35 is constituted by a number of parts interconnected by pins (not shown). The equalizer itself has been well known in the art so that it will not be described in detail.

When a sound current is passed through the moving coil 18, the current coacts with the magnetic flux in the air gap between the pole piece 15 and the yoke plate 13 whereby the coil 18 vibrates in the axial direction to transmit this vibration to the diaphragm 20. As a result, the diaphragm 20 vibrates axially with slight rotation and without radial displacement to produce second waves.

As above described, and shown in FIG. 5, since a plurality of equally spaced apart openings 24c are formed through the portion of the suspension member 24 adjacent the diaphragm 20, a chamber 40 surrounded by the suspension member 24, the coil bobbin 17, the coil 18, the yoke plate 13 and spacers 26a and 26b is communicated with a rear chamber 41 of the diaphragm 20 through openings 24c thus preventing the chamber 40 from deteriorating damping effect of the suspension member 24.

Moreover, as most clearly shown in FIG. 4, only the portions between the equally spaced openings 24c act as a supporting or suspension pieces of the diaphragms. For this reason, it is possible to increase the axial compliance of the diaphragm than the construction disclosed in the U.S. Pat. No. 4,050,541 described above. Moreover, the radial displacement is sufficiently prevented by equally spaced apart supporting members 24f. Consequently, it is possible to position the diaphragm 20 closely to and uniformly spaced from the equalizer 35. Moreover, it is possible to decrease, as far as possible, the width of the air gap 16 thus obtaining a horn type loudspeaker having a high conversion efficiency, excellent high frequency characteristic and phase characteristic.

Since the openings 24c, 24g and the notches 24a and 24b of the annular suspension member 24 can be formed by etching technique, such strain would not be generated in the suspension member as is inevitable when the openings are formed by punching. For this reason, when the diaphragm and the suspension member are assembled together, no mechanical strain would be formed between these members and the suspension member can be maintained flat. Especially, when the diaphragm and the suspension member are prepared independently as in the illustrated embodiment, a slight working strain of the diaphragm can be eliminated by adjusting the bonding condition of the diaphragm and the suspension member. This results in the following advantage. More particularly, at the time of assembling it is possible to maintain the diaphragm, the equalizer, the pole piece, the yoke plate and the coil bobbin at their correct relative positions, thus improving the characteristics of the loudspeaker.

When such highly resilient spring alloy as beryllium-copper alloy is used, the resistance to fatigue is improved so that the life of the loudspeaker can be prolonged than a case when other materials are used. With the construction described above the supporting members 24*f* have a large resiliency so that even when a large input is supplied to the moving coil 18 the diaphragm 20 would not collide against the equalizer 35 and the yoke plate 13.

In the embodiment described above the coil 18 wound around the bobbin 17 consists of only a single layer and the ends of the lead wires 18*a* and 18*b* are derived out to the rear side of the diaphragm 20 through openings 22*a* and 22*b* at the boundary between the diaphragm 20 and the suspension member 24 so that the lead wires 18*a* and 18*b* can loosely enter into the air gap without contacting the yoke plate 13 even when the diaphragm 20 vibrates in the axial direction with a large amplitude or slightly displaces in the radial direction. This means that it is possible to minimize, as for as possible, the width of the air gap 16 so as to obtaining a high conversion efficiency.

It will be clear that the invention is not limited to the specific embodiment described above and that various changes and modifications may be made within the scope of the invention as defined in the appended claims. For example, in the illustrated embodiment, although the invention was applied to a rear type loudspeaker, it is also applicable to a front type loudspeaker, in which case a moving coil is disposed in an air gap, and an equalizer and a horn are disposed in front of such a suspension member as described above. Although in the foregoing embodiment the suspension member and the diaphragm were prepared independently and then bonded together, they may be formed as integrated unit from the first. In this case the openings 24*c*, 24*g* and the notches 24*a* and 24*b* are formed by etching after shaping. Furthermore, instead of forming notches for the flange 20*b* of the diaphragm 20 and the inner ring 24*d* of the suspension member 24 for the purpose of deriving out the lead wires 18*a* and 18*b* of the moving coil 18 to the rear side of the diaphragm 20, a deep notch may be provided for either one of the flange 20*b* and the inner ring 24*d* and the notch may be partially covered by the other. Furthermore, although in the foregoing embodiment the annular plate member was prepared for the formation of the suspension member 24, the opening inside the inner ring 24*d* may be formed by photoetching a disc plate member at the same time as the photoetching of the openings 24*c*, 24*g* and the notches 24*a* and 24*d*.

What is claimed is:

1. A horn type loudspeaker comprising:

a diaphragm having a hemispherical top portion and a horizontal flange provided at the edge of said hemispherical top portion;

an annular light metal suspension plate, formed with a multiplicity of openings etched along a circle immediately proximate to the inner circumference of the annulus of said suspension plate, thereby dividing said suspension plate to define an inner and an outer suspension ring integrally connected by a multiplicity of resilient suspension support fingers so as to provide improved axial compliance of said diaphragm, and whereby said etched openings eliminate the internal cold working strains in said suspension plate;

a converting device for converting an audio frequency electrical signal into axial displacement of said diaphragm, said converting device comprising:

a coil bobbin disposed about the periphery of said diaphragm;

a coil wound thereupon; and a magnetic circuit including a magnetic air gap in which said coil is disposed, said coil and said bobbin being movable within said gap, whereby said audio frequency electrical signal supplied to said coil imparts axial vibration of said diaphragm;

passage means for passing electrical lead wires of said coil to terminals across the boundary defined by the suspension plate and diaphragm whereby interference between said wires and the yolk plate defining the outer boundary of said air gap is eliminated during large axial vibration and small radial deflections of said diaphragm, allowing a reduction of the cross-sectional width of said air gap for upgrading the conversion efficiency of said loudspeaker, wherein said passage means for passing lead wires comprises overlapping, etched, U-shaped cutout portions formed along the periphery of said diaphragm flange and said inner edge of said suspension plate, said cutout portions aligned to form a passage for said lead wires;

a horn; and an equalizer confronting said diaphragm at a small selected distance therefrom, thereby reducing undesirable phase interference at high frequencies resulting from variance between sound waves eminating from the central portion and peripheral portion of said diaphragm.

2. A loudspeaker according to claim 1 wherein each resilient suspension support finger comprises an elongated portion positioned between and equidistant from said inner and outer rings of said suspension plate, the inner and outer edges of said suspension support finger being parallel to the adjacent arcs of said inner and outer ring circumferences respectively, said ends of said elongated portion being provided with bends substantially perpendicular to said elongated portion to form radially extending connecting portions thereby connecting said ends of said elongated portion to said inner and outer suspension rings respectively.

3. A loudspeaker according to claim 1 wherein said etched light metal suspension plate comprises beryllium copper alloy for improved resistance to fatigue.

* * * * *

UNITED STATES PATENT AND TRADEMARK OFFICE

CERTIFICATE OF CORRECTION

PATENT NO. : 4, 367,377

DATED : 1-4-83

INVENTOR(S) : Mitsuhico Yamaguchi; Masayuki Uchiyama

It is certified that error appears in the above-identified patent and that said Letters Patent is hereby corrected as shown below:

| COLUMN | LINE | DESCRIPTION |
|---|---|---|
| 3 | 7 | Delete "The suspension", insert --Now referring to FIG. 4, the suspension--. |

Signed and Sealed this

*First* Day of *January 1985*

[SEAL]

*Attest:*

*Attesting Officer*

GERALD J. MOSSINGHOFF

*Commissioner of Patents and Trademarks*